US007033988B2

(12) United States Patent
Norwood et al.

(10) Patent No.: US 7,033,988 B2
(45) Date of Patent: Apr. 25, 2006

(54) DETERGENT TABLETS COMPRISING SOLUBILITY AIDS

(75) Inventors: Kevin Todd Norwood, Cincinnati, OH (US); Gayle Marie Frankenbach, Cincinnati, OH (US); Rajeev Ashok Modi, Canton, OH (US); Mike Rene Weaver, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 78 days.

(21) Appl. No.: 10/348,705

(22) Filed: Jan. 22, 2003

(65) Prior Publication Data

US 2003/0158073 A1 Aug. 21, 2003

Related U.S. Application Data

(60) Provisional application No. 60/366,052, filed on Mar. 20, 2002, provisional application No. 60/351,056, filed on Jan. 23, 2002.

(51) Int. Cl.
*C11D 17/00* (2006.01)
*C11D 3/37* (2006.01)

(52) U.S. Cl. ..... 510/446; 510/298; 510/505

(58) Field of Classification Search ..... 510/407, 510/505, 446, 298
See application file for complete search history.

(56) References Cited

U.S. PATENT DOCUMENTS 3,331,780 A * 7/1967 Krusius ..... 510/298
3,976,601 A 8/1976 Levin ..... 253/363.5
5,474,698 A * 12/1995 Rolando et al. ..... 510/445
5,853,430 A * 12/1998 Shindo et al. ..... 8/137
6,087,311 A * 7/2000 Van Dijk ..... 510/294
6,133,227 A * 10/2000 Barnabas et al. ..... 510/530
6,174,521 B1 * 1/2001 Li et al. ..... 424/65
6,239,091 B1 * 5/2001 Tartakovsky et al. ..... 510/220
6,361,783 B1 * 3/2002 Moaddel et al. ..... 424/401
6,511,952 B1 * 1/2003 Schwartz ..... 510/361

FOREIGN PATENT DOCUMENTS

| | | |
|---|---|---|
| EP | 0733738 | 10/1996 |
| WO | WO 91/17238 | 11/1991 |
| WO | WO 98/13466 A1 * | 4/1998 |
| WO | WO 00/00174 | 1/2000 |
| WO | WO 00/00174 A1 * | 1/2000 |
| WO | WO 00/14196 A1 * | 3/2000 |
| WO | WO 00/34422 | 6/2000 |
| WO | WO 01/10993 | 2/2001 |
| WO | WO 01/51600 | 7/2001 |

* cited by examiner

*Primary Examiner*—Lorna M. Douyon
(74) *Attorney, Agent, or Firm*—Mark A. Charles; Armina E. Matthews; Marianne Dressers

(57) ABSTRACT

Detergent compositions, preferably tablets, comprise an improved solubility aid wherein the solubility aid contains an organic molecule, which has a first polar group and a second polar group separated from each other by less than 5 aliphatic carbon atoms. The use of the solubility aid provides detergent tablets which are both strong and durable to resist breakage during storage and transportation, but which also disintegrate rapidly upon contact with an aqueous wash solution so that the components of the tablet can provide detersive benefits during the wash process.

8 Claims, No Drawings

DETERGENT TABLETS COMPRISING SOLUBILITY AIDS

CROSS REFERENCE TO RELATED APPLICATIONS

This application claims priority under 35 U.S.C. § 119(e) to U.S. Provisional Application Ser. No. 60/351,056 filed Jan. 23, 2002, and U.S. Provisional Application Ser. No. 60/366,052 filed Mar. 20, 2002.

FIELD OF THE INVENTION

The present invention relates to detergent compositions, particularly tablets and those compositions adapted for use in an automatic clothes washing machine, which comprise improved solubility aid compositions, wherein the solubility aid comprises organic molecules.

BACKGROUND OF THE INVENTION

It is known to make detergent compositions in tablet form by compacting a granular detergent composition. Such tablets offer the convenience to consumers of a pre-measured detergent dosage without the inconvenience and untidiness of measuring a sufficient amount of a granular detergent composition for each wash. Such products also offer considerable convenience to those consumers who launder the clothes outside or away from their residence (e.g. at a laundromat) because the consumer is required to transport only precisely as much laundry detergent as needed for clothes laundering.

However, while detergent compositions in tablet form have a number of advantages over conventional granular laundry detergent products, there are also disadvantages in using them. In particular, detergent tablets can be very "friable", meaning that they are weak and may easily break apart into smaller pieces during manufacture, transportation and storage. Such product integrity degradation is not only immediately undesirable to a consumer from an aesthetics standpoint, but also eliminates many of the advantages that detergent compositions in a tablet form have over conventional granular products. Given the foregoing, there is a continuing need to provide detergent tablets which are strong and durable and can withstand the agitation and disturbances, which are incidental to their manufacture, transportation and storage.

There are several approaches for enhancing the strength and durability of tablet detergent compositions, including packing the constituent particles which form the tablets more tightly by compacting them at higher compacting pressures and including a binder which provides a cohesive effect on the tablets. However, while these approaches may provide a stronger detergent tablet they may also introduce another disadvantage to detergent tablets. Because of their compact nature there is less surface area immediately in contact with the wash water and therefore, they dissolve more slowly. The inhibited disintegration of the tablets when contacted with the wash liquor during use limits the availability of functional detersive benefits that can be provided. Slow dissolving tablets have the additional disadvantage in that they can deposit visible detergent residues on clothes.

Accordingly the need remains for detergent tablets which are both strong and durable to resist breakage during storage and transportation, but which also disintegrate rapidly upon contact with wash water so that the components of the tablet can provide detersive benefits during the wash process.

The present invention meets the aforementioned needs by providing a detergent composition in tablet form comprising an improved solubility aid, which also functions as a binder. The resulting tablets are of a low friability and can thus be stored and transported easily without breakage, and also disintegrate rapidly during the wash processes conducted using either semi-automatic, automatic or hand washing machines.

It has now been discovered that certain solubility aids also provide benefits as binding agents and that the addition of these solubility aids to a particulate detergent composition which is subsequently formed into a tablet provides a strong, durable tablet with excellent disintegration and dissolution properties so that the detersive benefits of the tablet components are available for nearly the entire length of the wash process. Additionally, less detergent residue is deposited on fabrics laundered with said tablets.

SUMMARY OF THE INVENTION

The present invention relates to a detergent tablet comprising a detersive surfactant, a builder, and a solubility aid comprising an organic molecule, which has a first polar group and a second polar group separated from each other by less than 5 aliphatic carbon atoms.

The present invention further relates to a solubility aid comprising from about 3% to about 99.9% by weight of the composition of an organic molecule which has a first polar group and a second polar group separated from each other by less than 5 aliphatic carbon atoms; and from about 0.01% to about 97% by weight of the composition of polyethylene glycol with a molecular weight of from about 2000 to about 12000, preferably from about 4000 to about 8000.

Preferably the solubility aid comprises an organic molecule selected from the group consisting of 2,2,4 trimethyl 1,3 pentanediol, and 1,2 hexanediol and mixtures thereof. All parts, percentages and ratios used herein are expressed as percent weight unless otherwise specified.

DETAILED DESCRIPTION OF THE INVENTION

Definitions

As used herein, the terms "wash-water", "wash liquor" and "wash solution" mean a mixture of water and the non-aqueous detergent composition taught herein. This "wash-water", "wash liquor" and "wash solution" is most typically contained in an automatic washing machine, but it may also be contained in a bucket, sink or any other container capable of holding a liquid.

By "solubility aid" is meant a composition or compound with the ability to decrease the tendency of organic molecules such as surfactants to "gel" or form viscous phases that inhibit the dispersion and dissolution of the detergent. Additionally, solubility aids according to the present invention also provide binder benefits.

By "dissolution" is meant the rate at which the detergent product mixes with water and releases the active ingredients in the wash.

Solubility Aid

Solubility aids according to the present invention function as solubility aids as well as having a cohesive effect on the tablets. Detergent tablet formulations may contain at least a small amount of binding agent in the composition in order to provide a cohesive effect and promote the integrity of the tablets. However, the inclusion of a binding agent may impede solubility of the composition.

In addition to the cohesive effect that they provide, these solubility aids also help to prevent gelling of the detergent compositions taught herein. Gelling has been previously observed in detergent products prepared without the solubility aids as defined in the present invention, when the products are first contacted and diluted with water. Without being limited by theory, it is believed that this gelling phenomenon results from the surfactant-containing particles forming viscous surfactant phases (typically lamellar, spherulitic or hexagonal phases) upon contact with water in the wash-liquor or wash-water at certain concentrations of surfactant.

It has been discovered in the present invention that the addition of a suitable solubility aid, which consists of two polar groups separated by less than 5 aliphatic carbon atoms prevents the formation of the viscous surfactant phase. Examples of suitable solubility aid compositions include but are not limited to 2,2,4 trimethyl 1,3 pentanediol and 1,2 hexanediol. Mixtures of these organic molecules or any number of solubility aids are also acceptable.

Without being bound by theory, it is believed that the solubility aids described above prevent the formation of the viscous surfactant phases formed upon dilution, because the solubility aid can effectively interact with the ordered, structured layers of surfactant molecules, disrupt them and promote the formation of low—viscosity surfactant phases.

In addition to the solubility aids according to the present invention, detergent tablets may also include additional non-gelling binders. Non-gelling binders provide additional cohesive benefits. When additional non-gelling binders are present the organic molecule is preferably present in an amount from about 5% to about 50% by weight of the composition, more preferably, from about 10% to about 30% by weight of the composition and the non-gelling binder is preferably present in an amount from about 50% to about 95% by weight of the composition more preferably from about 70% to about 90% by weight of the composition. Further when present the ratio of organic molecule to additional non-gelling binder is preferably from about 2:1 to about 60:1, more preferably from about 3:1 to about 30:1 and most preferably, from about 3:1 to about 15:1.

If additional non-gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, lists several others. Most preferable binders also have an active cleaning function in the laundry wash.

Non-gelling binder materials are preferably sprayed on and hence have an appropriate melting point temperature below about 90° C., preferably below about 70° C. and even more preferably below about 50° C. so as not to damage or degrade the other active ingredients in the matrix. Most preferred are non-aqueous liquid binders (i.e. not in aqueous solution), which may be sprayed in molten form. However, they may also be solid binders incorporated into the matrix by dry addition but which have binding properties within the tablet.

The detergent tablets prepared according to the present invention will comprise from about 0.05% to about 5%, preferably from about 0.1% to about 3%, most preferably from about 0.1% to about 1% of a solubility aid according to the present invention. When additional optional non-gelling binder materials are used, they can be present at levels of from about 0.1% to about 7%, preferably from about 0.5% to about 5%, more preferably from about 1% to about 3% of the detergent tablet. When optional non-gelling binders are used they will be present in the detergent tablets in a ratio of non-gelling binder to solubility aid of from about 3:2 to about 60:1, preferably from about 2:1 to about 30:1, more preferably from about 3:1 to about 15:1.

It is understood that although the preferred embodiment is that of a detergent tablet, the solubility aids according to the present invention may also be incorporated into granular detergent compositions. In such a case the solubility aid may be added as part of the agglomeration or other detergent making process known to those in the art. When used in granular detergents the solubility aids of the present invention help to increase the solubility of the granular detergent.

It is also contemplated that the solubility aids disclosed herein could be used in any other application wherein a cohesive effect and rapid dissolution are desired.

Disintegrants

Although it is necessary that the tablets should have good integrity before use, it is necessary also that they should disintegrate rapidly during use, when contacted with wash-water. Thus it is also known to include a disintegrant, which will promote disintegration of the tablet. Various classes of disintegrant are known, including the class in which disintegration is caused by swelling of the disintegrant. Various swelling disintegrants have been proposed in the literature, with the preference being directed predominantly towards starches, celluloses and water-soluble organic polymers. Inorganic swelling disintegrants such as bentonite clay have also been mentioned in EP-A-466 484.

Some materials act as solubility aids and disintegrants. It is also mentioned in EP A-466 484 that the disintegrant may give supplementary building, anti-redeposition or fabric softening properties. The amount of disintegrant is preferably about 1 to about 5%. It is proposed in EP-A-466 484 that the tablet may have a heterogeneous structure comprising a plurality of discrete regions, for example layers, inserts or coatings.

Tablet Manufacture

Detergent tablets of the present invention can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients.

The ingredients such as builder and surfactant can be spray-dried in a conventional manner and then compacted at a suitable pressure. Preferably, the tablets according to the invention are compressed using a force of less than 100000 N, more preferably of less than 50000 N, even more preferably less than 5000 N and most preferably of less than 3000 N. Indeed, the most preferred embodiment is a tablet compressed using a force of less than 2500 N.

The particulate material used for making the tablet of this invention can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige(R) CB and/or Lodige(R) KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain. Preferably the particle size for use in tablets according to the present invention is from about 150 micrometers to about 850 micrometers, more preferably from about 250 micrometers to about 650 micrometers.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). The solubility aids of the present invention and optional additional non-gelling binders may be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the solubility aid, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy(R), Korch (R), Manesty(R), or Bonals(R)). The tablets prepared according to this invention preferably have a diameter of between 20 mm and 60 mm, preferably of at least 35 and up to 55 mm, and a weight between 15 g and 100 g. The ratio of height to diameter (or width) of the tablets is preferably greater than 1:3, more preferably greater than 1:2. The compaction pressure used for preparing these tablets need not exceed 100000 kN/m2, preferably not exceed 30000 kN/m2, more preferably not exceed 5000 kN/m2, even more preferably not exceed 3000 kN/m2 and most preferably not exceed 1000 kN/m2. In a preferred embodiment according to the invention, the tablet has a density of at least 0.9 g/cc, more preferably of at least 1.0 g/cc, and preferably of less than 2.0 g/cc, more preferably of less than 1.5 g/cc, even more preferably of less than 1.25 g/cc and most preferably of less than 1.1 g/cc.

Multi-layer tablets can be made by known techniques.

Coating

Solidity of the tablet according to the invention may be further improved by making a coated tablet, the coating covering a non-coated tablet according to the invention, thereby further improving the mechanical characteristics of the tablet while maintaining or further improving dispersion.

In one embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up when subjected to stronger mechanical shock. Furthermore, it is advantageous if the coating material is dispersed under alkaline conditions, or is readily emulsified by surfactants. This contributes to avoiding the problem of visible residue in the window of a front-loading washing machine during the wash cycle, and also avoids deposition of particles or lumps of coating material on the laundry load.

Water solubility is measured following the test protocol of ASTM E1148-87 entitled, "Standard Test Method for Measurements of Aqueous Solubility".

Suitable coating materials are dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. The coating material has a melting point preferably of from about 40° C. to about 200° C.

The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below about 40° C. are not sufficiently solid at ambient temperatures and it has been found that materials having a melting point above about 200° C. are not practicable to use. Preferably, the materials melt in the range from about 60° C. to about 160° C., more preferably from about 70° C. to about 120° C.

By "melting point" is meant the temperature at which the material when heated slowly in, for example, a capillary tube becomes a clear liquid.

A coating of any desired thickness can be applied according to the present invention. For most purposes, the coating forms from about 1% to about 10%, preferably from about 1.5% to about 5%, of the tablet weight.

The tablet coatings are preferably hard and provide extra strength to the tablet.

In a preferred embodiment of the present invention the fracture of the coating in the wash is improved by adding a disintegrant in the coating. This disintegrant will swell once in contact with water and break the coating in small pieces.

This will improve the dispersion of the coating in the wash solution. The disintegrant is suspended in the coating melt at a level of up to 30%, preferably between 5% and 20%, most preferably between 5 and 10% by weight. Possible disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins and mixtures thereof.

Effervescent

In another preferred embodiment of the present invention the tablets further comprise an effervescent.

Effervescency as defined herein means the evolution of bubbles of gas from a liquid, as the result of a chemical reaction between a soluble acid source and an alkali metal carbonate, to produce carbon dioxide gas. Examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles.

Further dispersion could be provided by using compounds such as sodium acetate or urea. A list of suitable dispersion aid may also be found in Pharmaceutical Dosage Forms: Tablets, Volume 1, Second edition, Edited by H. A. Lieberman et all, ISBN 0-8247-8044-2.

Clays

Clay minerals may be used to provide softening properties to the instant compositions and can be described as expandable, three-layer clays, i.e., alumino-silicates and magnesium silicates, having an ion exchange capacity of at least 50 meq/100 g. of clay. The term "expandable" as used to describe clays relates to the ability of the layered clay structure to be swollen, or expanded, on contact with water. The three-layer expandable clays used herein are those materials classified geologically as smectites.

Detersive Surfactants

Non-limiting examples of surfactants useful herein typically at levels from about 1% to about 55%, by weight, anionics such as sulphonates, sulphates and ether sulphates. These include the conventional C11–C18 alkyl benzene sulfonates ("LAS") and primary, branched-chain and random C10–C20 alkyl sulfates ("AS"), the C10–C18 secondary (2,3) alkyl sulfates of the formula $CH_3(CH2)_x(CHOSO_3—M^+)$ $CH_3$ and $CH_3$ $(CH_2)_y(CHOSO_3—M+)$ $CH_2CH_3$ where x and (y+1) are integers of at least about 7, preferably at least about 9, and M is a water-solubilizing cation, especially sodium, unsaturated sulfates such as oleyl sulfate, the C10–C18 alkyl alkoxy sulfates ("AExS"; especially EO 1–7 ethoxy sulfates), C10–C18 alkyl alkoxy carboxylates (especially the $EO_{1-5}$ ethoxycarboxylates), the C10–18 glycerol ethers, the C10–C18 alkyl polyglycosides and their corresponding sulfated polyglycosides, and C12–C18 alpha-sulfonated fatty acid esters. If desired, the conventional nonionic and amphoteric surfactants such as the C12–C18 alkyl ethoxylates ("AE") including the so-called narrow peaked alkyl ethoxylates and C6–C12 alkyl phenol alkoxylates (especially ethoxylates and mixed ethoxy/propoxy), C12–C18 betaines and sulfobetaines ("sultaines"), C10–C18 amine oxides, and the like, can also be included in the overall compositions. The C10–C18 N-alkyl polyhydroxy fatty acid amides can also be used. Typical examples include the C12–C18 N-methylglucamides. See WO 92/06154. Other sugar-derived surfactants include the N-alkoxy polyhydroxy fatty acid amides, such as C10–C18 N-(3-methoxypropyl) glucamide. The N-propyl through N-hexyl C12–C18 glucamides can be used for low sudsing. C10–C20 conventional soaps may also be used. If high sudsing is desired, the branched-chain C10–C16 soaps may be used. Mixtures of anionic and nonionic surfactants are especially useful. Other conventional useful anionic, amphoteric, nonionic or cationic surfactants are listed in standard texts.

Additionally and preferably, the surfactant may be a midchain branched alkyl sulfate, midchain branched alkyl alkoxylate, or midchain branched alkyl alkoxylate sulfate. These surfactants are further described in PCT Application No. WO 99/19434, published Apr. 22, 1999, PCT Application No. WO 99/18929, published Apr. 22, 1999, U.S. Pat. No. 6,228,829 issued May 8, 2001, U.S. application Ser. No. 09/542,684 allowed Apr. 10, 2001, PCT Application No. WO 99/19448 published Apr. 22, 1999 and U.S. application Ser. No. 09/543,087 allowed Apr. 10, 2001. Other suitable mid-chain branched surfactants can be found in U.S. Pat. No. 6,008,181, issued Dec. 28, 1999, U.S. Pat. No. 6,060,443, issued May 9, 2000, U.S. Pat. No. 6,020,303, issued Feb. 1, 2000, U.S. Pat. No. 6,093,856, issued Jul. 25, 2000, PCT application No. WO 97/38972 published Oct. 23, 1997, U.S. Pat. No. 6,046,152, issued Apr. 4, 2000, and U.S. Pat. No. 6,015,781, issued Jan. 18, 2000. Mixtures of these branched surfactants with conventional linear surfactants are also suitable for use in the present compositions.

Other preferred anionic surfactants are the modified alkyl benzene sulfonate surfactants, or MLAS. Some suitable MLAS surfactants, methods of making them and exemplary compositions are further described in U.S. Pat. No. 6,274,540, issued Aug. 14, 2001, PCT Application No. WO 99/05242, published Feb. 4, 1999, U.S. application Ser. No. 09/479,365, allowed Jun. 7, 2001, PCT Application No. WO 99/05082, published Feb. 4, 1999, PCT Application No. WO 99/05084, published Feb. 4, 1999, PCT Application No. WO 99/05241, published Feb. 4, 1999, PCT Application No. WO 99/07656, published Feb. 18, 1999, PCT Application No. WO 00/23549, published Apr. 27, 2000, and PCT Application No. WO 00/23548, published Apr. 27, 2000.

In preferred embodiments, the tablet comprises at least 5% by weight of surfactant, more preferably at least 10% by weight. The amount of anionic is preferably at least 1.5 times, generally at least 2 or 3 times, the total amount of other surfactants.

Builders

Detergent builders can optionally be included in the compositions herein to assist in controlling mineral hardness. Inorganic as well as organic builders can be used. Builders are typically used in fabric laundering compositions to assist in the removal of particulate soils. The level of builder can vary widely depending upon the end use of the composition.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSixO_2x+1.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Mz(zAlO_2)y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Further examples of suitable builders are discussed at greater length in the pending U.S. Patent Application of Salager et al., entitled "Coated Detergent Tablet", having Ser. No. 09/319,475, filed on Jun. 4, 1999.

Bleach

The detergent compositions herein may contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

Suitable bleaching agents and bleach activators are discussed at greater length in the pending U.S. Patent Application of Salager et al., entitled "Coated Detergent Tablet", having Ser. No. 09/319,475, filed on Jun. 4, 1999.

As a practical matter, and not by way of limitation, the compositions and processes herein can be adjusted to provide on the order of at least one part per ten million of the active bleach activator species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably about 0.01% to about 1% by weight of a commercial enzyme preparation. Protease enzymes are usually present in such commercial preparations at levels sufficient to provide from about 0.005 to about 0.1 Anson units (AU) of activity per gram of composition. Suitable enzymes for use in the present invention are discussed at greater length in the pending U.S. Pat. Application of Salager et al., entitled "Coated Detergent Tablet", having Ser. No. 09/319,475, filed on Jun. 4, 1999.

The following examples are illustrative of the present invention, but are not meant to limit or otherwise define its scope. All parts, percentages and ratios used herein are expressed as percent weight unless otherwise specified.

EXAMPLES

Example 1a i) A detergent base powder of composition A (see table 1) is prepared as follows: all the particulate materials of base composition A are mixed together in a mixing drum to form a homogenous particulate mixture.

ii) 1.6 part of polyethyleneglycol to 0.4 parts of 1,2 hexandiol are mixed together then sprayed onto 98 parts of base powder of composition A while mixing.

iii) Tablets are then made the following way. 54 g of the mixture is introduced into a mold of circular shape with a diameter of 5.5 cm and compressed at a force of 2200N with an Instron 4464 press.

iv) Optionally, tablets may then be coated.

Example 1b i) The same composition A is prepared following the same process as in example 1a.

ii) 1.6 parts of polyethyleneglycol and 0.4 parts of 2,2,4 trimethyl 1,3 pentanediol are mixed together and sprayed onto 98 parts of base powder of composition A while mixing.

iii) Tablets are then made following the same way as described in example 1a.

Examples 2a–2b are prepared in an analogous fashion to the process described above in Examples 1a and 1b with the exception that Composition B powder is substituted for Composition A powder.

TABLE 1

| | Composition A (%) | Composition B (%) |
|---|---|---|
| Anionic agglomerates[1] | 20 | 40 |
| Blown Powder[2] | 40 | 20 |
| Sodium percarbonate | 10 | 3 |
| Bleach activator agglomerates | 5 | 0 |
| Sodium carbonate | 16.9 | 17.9 |
| Fluorescent whitening agent | 0.1 | 0.1 |
| Citric acid | 7.0 | 6.0 |
| Protease | 0.5 | 0.5 |
| Amylase | 0.5 | 0.5 |

[1]Anionic agglomerates comprise about 30% anionic surfactant, about 50% aluminosilicate, about 3% sodium carbonate, about 2% PEG, and about 15% moisture.

[2]Blown powder comprises about 15% anionic surfactant, about 5% polycarboxylate, about 20% aluminosilicate, about 43% sodium carbonate, about 2% PEG, about 2% chelant, and about 13% moisture.

The Example compositions are described in the table below.

TABLE 2

| | Example 1a | Example 1b | Example 2a | Example 2b |
|---|---|---|---|---|
| Powder A | 98% | 98% | | |
| Powder B | | | 98% | 98% |
| Polyethyleneglycol 4000 | 1.6% | 1.6% | 1.6% | 1.6% |
| 2,2,4 trimethyl 1,3 pentanediol | | 0.4% | | 0.4% |
| 1,2 hexanediol | 0.4% | | 0.4% | |

What is claimed is:

1. A detergent tablet comprising:

(a) a detersive surfactant;

(b) a builder; and (c) from about 0.05% to about 7%, by weight of the detergent tablet, of a solubility aid comprising:

(i) from about 5% to about 50%, by weight of the solubility aid, of an organic molecule which has a first polar group and a second polar group, wherein the first polar group and the second polar group are separated from each other by less than 5 aliphatic carbon atoms; and (ii) from about 50% to about 95%, by weight of the solubility aid, of polyethylene glycol.

2. A detergent tablet according to claim 1 wherein the organic molecule is selected from the group consisting of 2,2,4 trimethyl 1,3 pentanediol; 1,2, hexanediol; and mixtures thereof.

3. A detergent tablet according to claim 2 wherein the organic molecule is 2,2,4 trimethyl 1,3 pentanediol.

4. A detergent tablet according to claim 1 wherein the solubility aid further comprises a non-gelling binder.

5. A detergent tablet according to claim 1, further comprising a disintegrant.

6. A detergent tablet according to claim 1, further comprising a coating.

7. A detergent tablet according to claim 6 wherein the coating comprises at least one dicarboxylic acid.

8. A detergent tablet according to claim 6, further comprising an effervescent.

* * * * *